US009114908B2

(12) United States Patent
Roesler

(10) Patent No.: US 9,114,908 B2
(45) Date of Patent: Aug. 25, 2015

(54) STACKABLE PACKING BOX

(71) Applicant: Peter Roesler, Wangen (DE)

(72) Inventor: Peter Roesler, Wangen (DE)

( * ) Notice: Subject to any disclaimer, the term of this patent is extended or adjusted under 35 U.S.C. 154(b) by 0 days.

(21) Appl. No.: 13/942,978

(22) Filed: Jul. 16, 2013

(65) Prior Publication Data

US 2014/0014653 A1 Jan. 16, 2014

(51) Int. Cl.

| | |
|---|---|
| ***B65D 21/02*** | (2006.01) |
| ***B25H 3/02*** | (2006.01) |
| *B65D 25/04* | (2006.01) |

(52) U.S. Cl.

CPC ..... *B65D 21/0226* (2013.01); *B25H 3/022* (2013.01); *B65D 21/0228* (2013.01); *B65D 25/04* (2013.01)

(58) Field of Classification Search

CPC ..... B65D 21/0226; B65D 21/0209; B65D 21/0228; B65D 25/04; B25H 3/022

USPC ..... 220/23.6, 23.2, 23.4, 23.8, 23.83, 4.22, 220/4.23, 4.27, 504; 206/509, 512

See application file for complete search history.

(56) References Cited

U.S. PATENT DOCUMENTS

| | | | | |
|---|---|---|---|---|
| 2,078,488 | A | 4/1937 | Farnham | |
| 3,009,291 | A * | 11/1961 | Blackmore | 47/87 |
| 3,362,616 | A * | 1/1968 | Van Dyck | 206/746 |
| 5,409,127 | A * | 4/1995 | Stratford et al. | 220/23.4 |
| 2007/0295721 | A1 * | 12/2007 | Van Handel et al. | 220/23.6 |

FOREIGN PATENT DOCUMENTS

| | | | |
|---|---|---|---|
| DE | 2421969 | A | 5/1974 |
| DE | 3706288 | C2 | 11/1987 |
| DE | 202007008113 | U1 | 10/2007 |
| WO | 9318977 | A2 | 9/1993 |
| WO | 2005012104 | A2 | 2/2005 |

* cited by examiner

*Primary Examiner* — Fenn Mathew
*Assistant Examiner* — Don M Anderson
(74) *Attorney, Agent, or Firm* — Cohen & Grigsby, P.C.

(57) ABSTRACT

A packing box (1, 2) with a bottom wall (15) and adjoining side and end walls (3-8) and at least one closure lid (9, 10) is provided. Several roughly identical packing boxes (1, 2) may be joined to each other at their mutually adjacent side walls (4, 5) and may swivel about a breakable film hinge (17) and at least one breakable connection cam (14) spanning the film hinge which is arranged between the mutually adjoining side walls (4, 5).

16 Claims, 4 Drawing Sheets

Fig. 7

STACKABLE PACKING BOX

CROSS REFERENCE TO RELATED APPLICATIONS

The present application claims the benefit under 35 USC 119(e) of German Patent No. 10 2012 013 928.4 filed on Jul. 16, 2012, which is incorporated herein by reference in its entirety.

BACKGROUND OF THE INVENTION

1. Technical Field of the Invention

The presently disclosed invention relates to a stackable packing box with a bottom wall and adjoining side and end walls and at least one closure lid, wherein several roughly identical packing boxes are joined to each other at their mutually adjacent side or end walls by a connection cam and are able to swivel about a film hinge.

2. Background of the Invention

When packing small parts there is often a need to join together several packing boxes in order to obtain a larger multiple package that consists of several smaller packing boxes. It is known how to join and separate the multiple packing box arrangement when necessary. However, there is a need to provide several connected packing boxes with a common label and to select the size of the label so that it covers several packing boxes. In this way, one can check for the opening of one or more packing boxes from damage to the label. Moreover, there is a need, after separating the packing boxes, to coordinate them with each other in some way.

A configuration is known in the prior art in which a packing box has a plurality of interior partitions, i.e., individual compartments, wherein the overall packing box is closed by a single sliding lid. Generally the interior compartments of such a packing box are arranged in pairs. Consequently, opening the sliding lid by a certain distance will open two compartments at once. If, for example, tool pieces are arranged in the respective compartments of the interior partitioning, opening the lid will necessarily reveal the tools pieces in both compartments. Emptying or turning the package over to remove a tool piece from one compartment will always also remove the tool piece from the paired compartment. This is undesirable. Thus, instead of storing and retrieving the objects in pairs, there is a need to design the interior partitions of a packing box so that it is possible to make each compartment individually accessible.

It is also known in the prior art how to outfit such multiple packing boxes as a ten pack, i.e., there is a tenfold interior partitioning having two paired rows of five compartments each. When such a packing box is to be taken apart by machine, for example, it is also known how to open the packing box. However, it is not possible or known from the multiple packing boxes of the prior art how to remove only one piece from the interior partitioning. That is, it is not possible to remove an item from a single compartment using the packing boxes known thus far, which only have a single sliding lid and a plurality of paired partitioned compartments.

Therefore, the object of the presently disclosed invention is to modify a packing box of the kind mentioned at the outset so that it is possible to remove the objects specifically from individual compartments of a multiple partitioned packing box without emptying neighboring compartments in an undesirable fashion.

SUMMARY OF THE INVENTION

The above stated objects are achieved by the presently disclosed invention, which relates to a stackable packing box with a bottom wall and adjoining side and end walls and at least one closure lid, wherein several roughly identical packing boxes are joined to each other at their mutually adjacent side or end walls by a connection cam and are able to swivel about a film hinge.

The essential feature of the presently disclosed invention is that a packing box is now provided whose interior partitioning is chosen such that only single partitions arranged in succession are provided and one such package row can be closed by an individual sliding lid. Thus, there is the advantage that, when one sliding lid is opened, only one compartment of a row is held open and this one compartment can be emptied specifically by a simple turning over into one's hand when the sliding lid has been moved a certain distance to release this compartment. The neighboring box row that is closed by the other sliding lid is not affected by the opening of the one sliding lid, because the sliding lid assigned to the other box row remains closed.

In this way, it is possible for the first time to open only one compartment specifically in a packing box with multiple partitioning and remove a single object from this compartment by activating a single sliding lid assigned to this box row, while the sliding lid of the neighboring box row remains closed.

Another feature of the presently disclosed invention is that the individual packing boxes may be joined to each other at their mutually adjacent side or end walls by a connection cam. The connected packing boxes are further distinguished from the prior art in that they form a rigid (and strong) connection in one plane (for example, a horizontal plane). When necessary, it is possible to break the rigid connection between the packing boxes, in which case the connected packing boxes are only still movably connected to each other by a film hinge. This has the advantage that, after one breaks the connection cam between the coordinated packing boxes, these are now able to swing freely relative to each other, and the swinging movement is such that they are preferably pivoted by 180 degrees relative to each other so that the bottom surface of one packing box lies parallel to and at a mutual spacing from the bottom surface of the other packing box. In the space between the bottom surfaces there are arranged locking means which ensure that the packing boxes, which are pivoted relative to each other, can be locked together in the region of their two bottom surfaces when arranged parallel to each other and at a mutual spacing from each other.

Thus, disclosed herein are packing boxes that can be folded relative to each other, whose folding is possible only after overcoming a breaking obstacle. They can then be locked to each other at the bottom side.

The benefit of this feature is that now, for the first time, it is possible to implement a compact, space-saving folding of such a packing box. By folding the two box rows against each other, the resulting packing box is given a different format, roughly square, as viewed from the end face. The two rows of packing boxes arranged alongside each other are then stacked vertically on each other.

This produces a different format for storing of such packing boxes, since these can now be kept in a very space-saving manner in an automatic dispensing system, for example, for the automatic dispensing of the packing boxes. In such a system there is an automatic removal of one or more packing boxes at the push of a button. Hence, a stacked packing box in the folded condition can be removed from the automatic removal system and the individual objects can then be removed from one or more compartments of the interior partitioning.

The box rows folded on each other and preferably joined at the bottom side can have locking means in various configurations. In a first configuration, the locking can consist of locking ribs, wherein the locking ribs on the bottom surface of one packing box engage with complementary locking ribs on the bottom surface of the other packing box.

In another configuration, locking projections can be provided on the one bottom surface of the one packing box, engaging with complementary locking recesses on the bottom surface of the opposite packing box and being locked detachably there.

In a third configuration, magnetic locking means can also be used as detachable locking means, wherein a permanent magnet is arranged on the bottom surface of the one packing box and a suitable mating element on the bottom surface of the other packing box.

The presently disclosed invention provides that the mutually coordinated packing boxes are joined by a film hinge along their lengthwise sides (side walls), and this film hinge is preferably arranged in the bottom region of the side walls in order to make sure that, when the two packing boxes are swiveled along the pivot axis of the film hinge, the bottom surface of the one packing box ends up in a position opposite the bottom surface of the other packing box.

It is preferable to also have the at least one connection or tear-off cam arranged in the pivot area of the film hinge, because a low tearing force may then be required for the cam in this arrangement. The leverage that is exerted on the particular packing box to swivel the film hinge is then exerted at the same time as a tearing force on the tear-off cam.

The presently disclosed invention is not limited to providing only a single tear-off cam. Several tear-off cams situated at a mutual distance from each other can also be arranged in the area of the pivot axis of the film hinge. Of course, it is possible in another embodiment of the presently disclosed invention for the tear-off cam to be located on a different level (height on the side wall) than the level of the pivot axis of the film hinge.

It is of special advantage for the tear-off cam to be made from a plastic that is relatively hard, so as to produce an audible click when the tear-off cam is ripped open.

In one embodiment of the presently disclosed invention, the film hinge itself can also be ripped open, in order to fully separate the packing boxes joined along the lengthwise side from each other when necessary. It is also possible for the packing boxes to be movably joined together by the film hinge along their lengthwise sides and for at least one tear-off cam to be arranged in this region.

In another embodiment of the presently disclosed invention, it is provided that instead of the longitudinal joining of the packing boxes, these are now joined to each other at the end face by a film hinge and at least one tear-off cam. While the specification and figures focus on the longitudinal connection of the packing boxes having a film hinge and optional tear-off cam, the end-face connection of the packing boxes with a film hinge and a tear-off cam falls under the protected domain of the presently disclosed invention.

There is a need with automatic dispensing machines to break apart the individual packing boxes, i.e., to separate them from each other. In this way, one can keep on hand smaller quantities of the same kind of packaged item in the automatic dispensing machine. For this purpose, the two packing boxes joined together at the lengthwise side are swiveled relative to each other by manual force, so that the at least one tear-off cam arranged on the side wall breaks off with an audible clicking sound and the two packing boxes can then be swiveled about the pivot axis of the film hinge relative to each other, while at the same time a label covering the two packing boxes is torn. The film hinge can then be torn open.

Such a need to separate packing boxes exists not only to break apart several packing boxes joined to each other at the lengthwise side in automatic dispensing machines, but also for sales purposes, when it involves breaking apart a larger set of a packing box into individual rows of packing boxes. In this way, smaller numbers of units can be sold from a packing box.

It is preferable in this case to configure the closure lid as a sliding lid. The use of a sliding lid has the benefit that controlled movement of the sliding lid can ensure that only one compartment of a row of boxes is opened and only one item can be removed from this one compartment.

The subject of the presently disclosed invention is comprised not only of the subjects of the individual patent claims, but also the combination of the individual patent claims with each other.

All information and features disclosed in the documents, including the abstract, and especially the spatial configuration presented in the drawings, are claimed as essential to the invention, insofar as they are individually or in combination novel with respect to the prior art.

BRIEF DESCRIPTION OF THE DRAWINGS

In what follows, the presently disclosed invention will be explained more closely by means of drawings presenting only a single embodiment. Further features and benefits essential to the invention will emerge from the drawings and their description.

In the drawings.

DESCRIPTION OF PRESENTLY PREFERRED EMBODIMENTS

Figure 1:
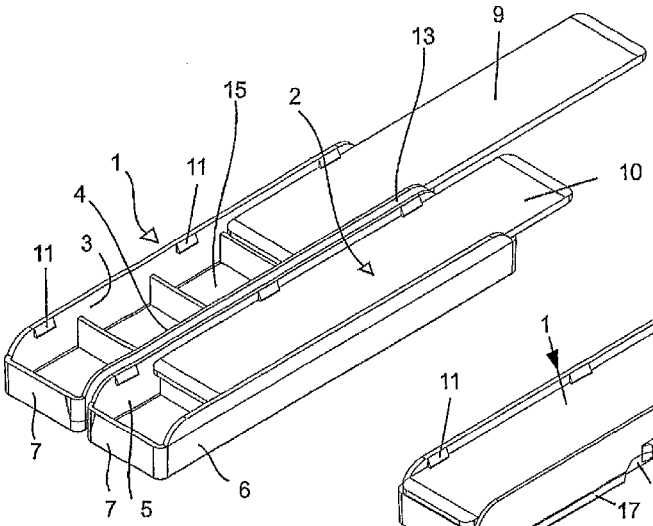
FIG. 1 shows a perspective view of two packing boxes joined together at the lengthwise side, being partly opened according to an embodiment of the presently disclosed invention.

FIG. 1 shows two packing boxes 1 and 2 joined together at the lengthwise side, being completely identical in construction. For this reason, the description of one packing box will suffice. The cross section, height and dimension of each packing box are optional. In the drawings, merely for better illustration, a rectangular contour of the packing box is shown. Accordingly, the packing boxes can also be polygonal, triangular, oval or round in configuration.

Figure 3:
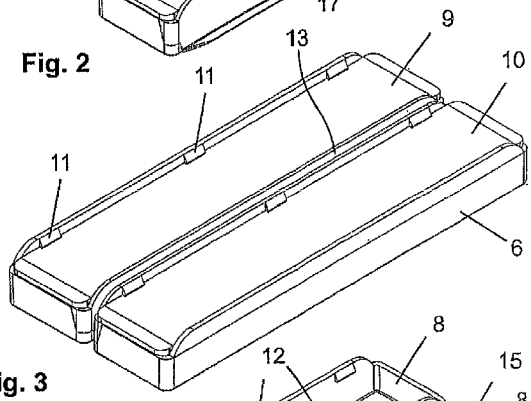
FIG. 3 shows the perspective view of the packing box of FIG. 1 in the closed condition.

The packing box 1 consists of the side walls (3, 4), which are joined together by corresponding end walls (7, 8; as can be seen in FIG. 3), and which proceed from a bottom wall 15.

The same holds for packing box 2, which consists of the side walls (5, 6), each of them being bounded by the end faces (7, 8; as can be seen in FIG. 3), and likewise being joined to a bottom wall 15.

In the sample embodiment shown, each packing box (1, 2) is closed by a closure lid (9, 10).

The closure lid (9, 10) may be configured as a sliding lid, and for the lengthwise guidance of the particular closure lid (9, 10) there are provided guide shoulders 11, directed into the inside, on the side walls (3, 4 and 5, 6) of the packing boxes (1, 2), which grip the respective closure lid (9, 10) from above and guide it.

The underside of the closure lid (9, 10) slides on the cross walls 12 partitioning the interior space of the packing boxes (1, 2).

Between the identically formed packing boxes (1, 2) there is formed a joint 13, producing a gap of around 1 to 2 mm. In the region of the facing side walls (4, 5) of the two packing boxes (1, 2), at the height of the bottom wall 15, there is provided a film hinge 17 running across almost the entire length of the side wall (4, 5). This consists of a thin, flexible and elastic film, which is joined as a single piece to the plastic material of the particular side wall (4, 5) of the packing box (1, 2).

Figure 2:
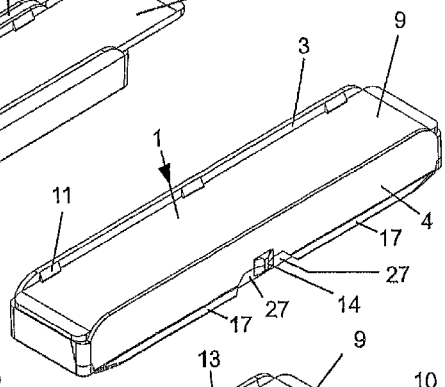
FIG. 2 shows the perspective view of the left packing box of FIG. 1, after the other packing box has been separated.

However, the film hinge 17 is not continuous, but rather interrupted in its middle region by interruptions 27 (see FIG. 2). In the region of this interruption 27, there is formed a connection or tear-off cam 14 made of a thicker plastic material on the side wall 4 of the one packing box and likewise on the side wall 5 of the opposite packing box 2. Moreover, the entire material of the entire packing box, including all its details, is formed from a uniform plastic material.

FIG. 3 shows the completely closed perspective representation of the two still connected packing boxes (1, 2).

Figure 4:
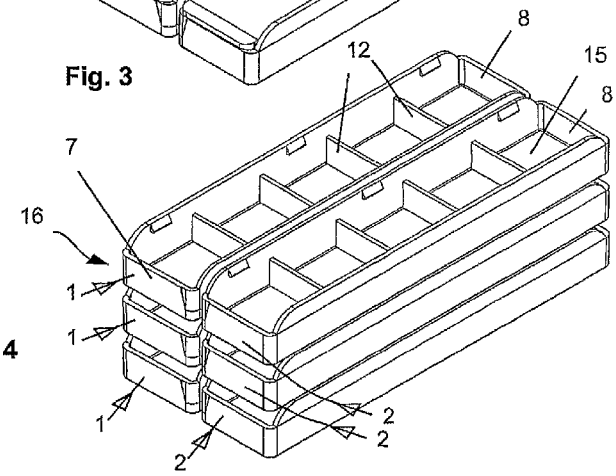
FIG. 4 shows a perspective view of a stack formed from packing boxes joined together in pairs, according to an embodiment of the presently disclosed invention.

FIG. 4 shows a perspective representation of the packing boxes (1, 2) arranged in pairs, now folded onto each other to form a stack 16, so that any given number of pairwise connected packing boxes (1, 2) can form a stack 16.

The presently disclosed invention, moreover, is not confined to the pairwise arrangement of packing boxes (1, 2). In another embodiment, another joint with another film hinge 17 and another connection cam 14 can be provided on the side wall 6 of the packing box 2, and another packing box can adjoin this one in turn.

Thus, as many packing boxes (1, 2) as desired can form a cohesive packing element, joined together at the lengthwise side and connected by at least one connection cam 14, being easily separable and easy to tear apart.

FIGS. 5 to 8 show the tearing open of the connection cam 14 that joins the two packing boxes together at the lengthwise side.

Figure 5:
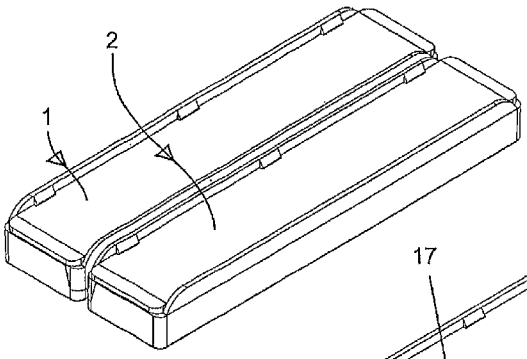
FIG. 5 shows a perspective view of two packing boxes joined together at the lengthwise side and in the closed condition, according to an embodiment of the presently disclosed invention.
Figure 6:
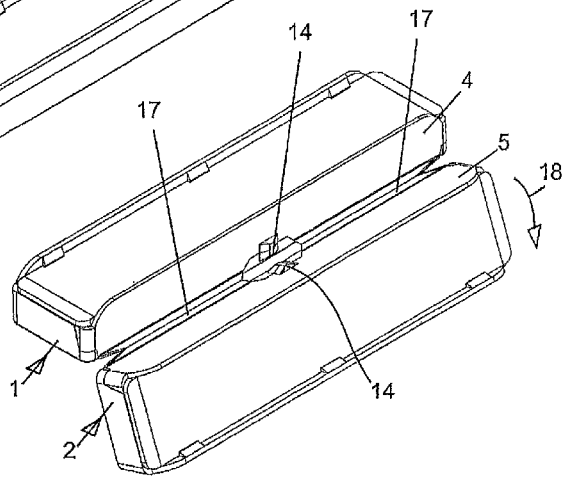
FIG. 6 shows the perspective view of the packing boxes of FIG. 5 broken apart, being joined to each other now only by the film hinge.

Starting with the representation of FIG. 5, FIG. 6 shows that when the packing box 2 is swung in the arrow direction 18 in relation to the stationary packing box 1, the connection cam 14 in the region of the side wall between the side walls (4, 5) of the packing boxes (1, 2) is broken open with an audible click and the two packing boxes (1, 2) are then only connected to each other by the film hinge 17 per FIG. 6.

Figure 7:
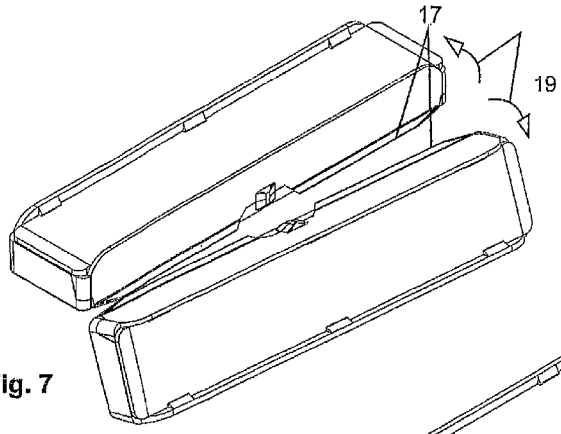
FIG. 7 shows the perspective view of the broken connection between the packing boxes of FIG. 6 with an additional tearing open of the film hinge.

FIG. 7 shows that the film hinge 17 can also be torn open if the two packing boxes are torn apart in the arrow direction 19.

Figure 8:
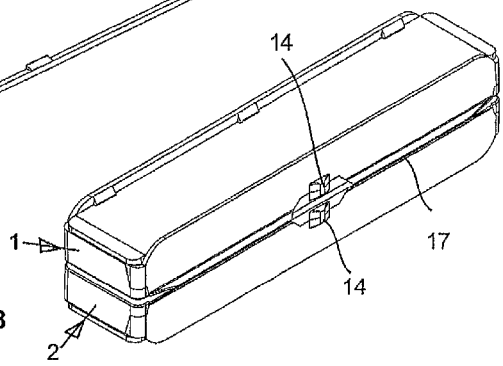
FIG. 8 shows the stacking of the two packing boxes on each other when swiveled further from the position of FIG. 6, with the film hinge intact.

The tearing open of the film hinge 17, however, is not required in order to achieve the stack position of FIG. 8. The two packing boxes forming a longitudinal member can accordingly be broken open, so that the one longitudinal member is separated from the other longitudinal member.

FIG. 8 shows that it is possible, with the film hinge 17 intact, to stack the two packing boxes 1, 2 on each other by a folding over, the bottom wall 15 of the one packing box 1 lying parallel to the bottom wall 15 of the other packing box 2 and the two bottom walls being locked together. This is shown more closely in FIGS. 9 and 10.

Figure 9:
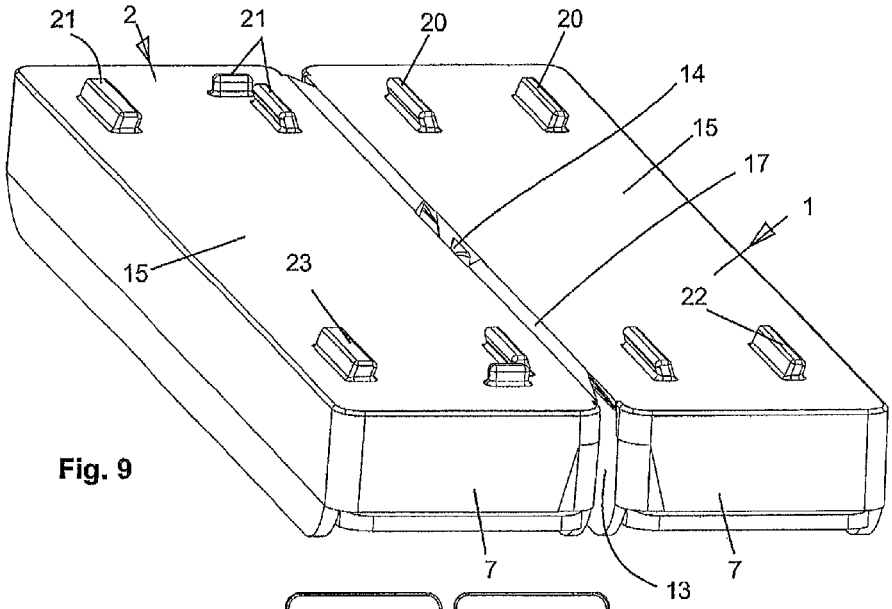
FIG. 9 shows a perspective representation of two packing boxes seen from the bottom, according to an embodiment of the presently disclosed invention.
Figure 10:
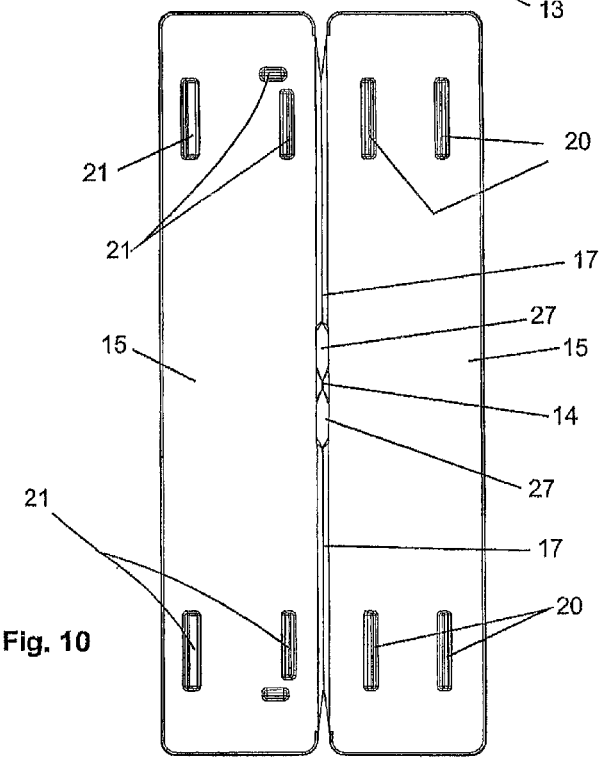
FIG. 10 shows a top view of the bottom of the two packing boxes of FIG. 9, joined together.

FIGS. 9 and 10 show, as a first possibility for the locking, that snap-in buttons 20 are provided on the bottom wall 15 of the packing box 1, which interact with matching snap-in buttons 21 on the opposite bottom wall 15 of the other packing box 2.

The snap-in buttons (20, 21) each form sideways locking edges (22, 23), which engage with each other to produce a detachable connection of the two coordinated bottom walls 15.

The snap-in button 21 arranged perpendicular to this serves as a lengthwise end stop to prevent a mutual displacement of the two bottom surfaces 15 in the lengthwise direction.

Figure 11:
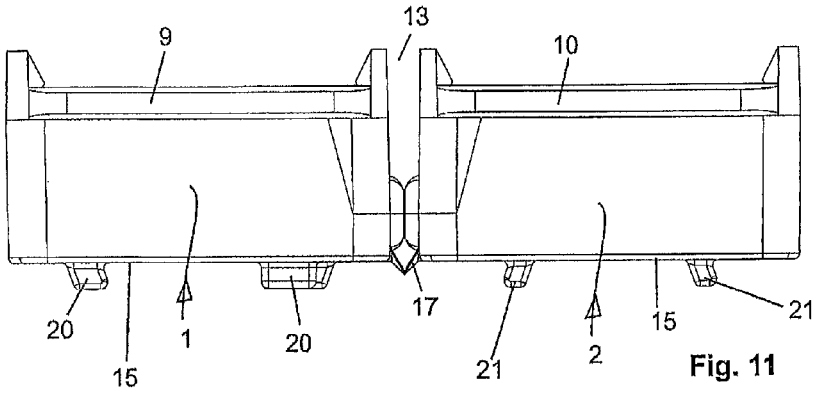
FIG. 11 shows an end view of the two packing boxes of FIG. 9, joined together.
Figure 13:
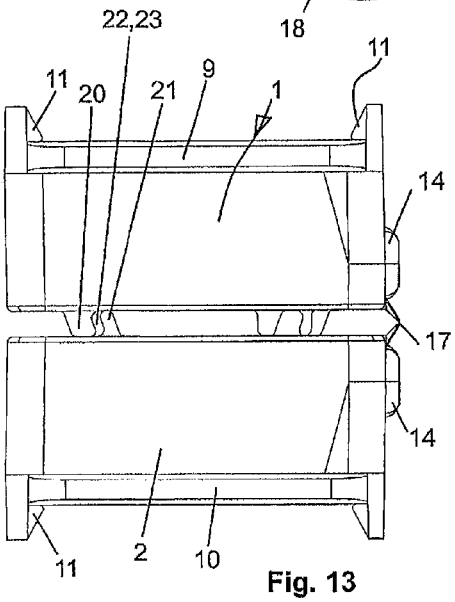
FIG. 13 shows the end view of the two packing boxes of FIG. 9, stacked on each other and joined together via the film hinge.

FIG. 11 shows the slightly conical shape of the matching snap-in buttons (20, 21), so that their locking edges (22, 23) mutually engage, as is shown in FIG. 13 in the stacked position of the two packing boxes (1, 2).

Figure 12:
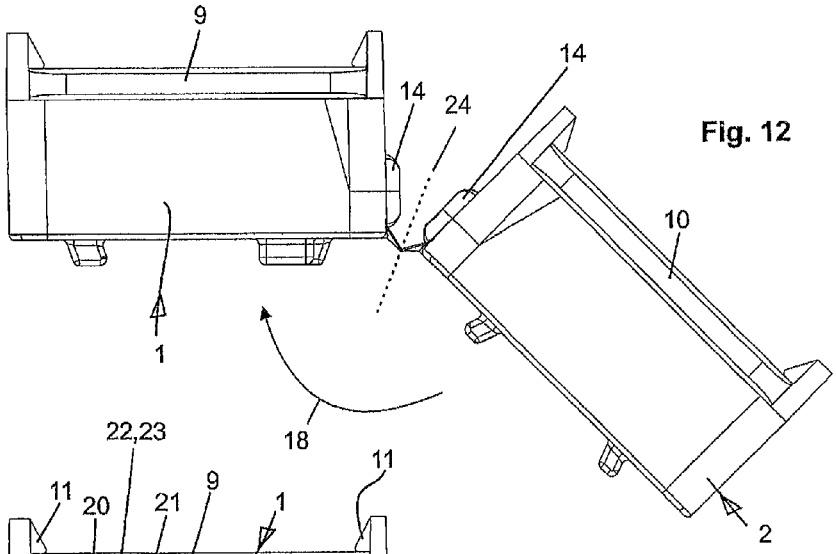
FIG. 12 shows the end view of the two packing boxes of FIG. 9, when the connection cam has been separated.

FIG. 12 shows the pivot axis 24 formed by the film hinge 17, and also that the connection cam 14 is arranged roughly at the height of the film hinge or slightly above the film hinge.

Figure 14:
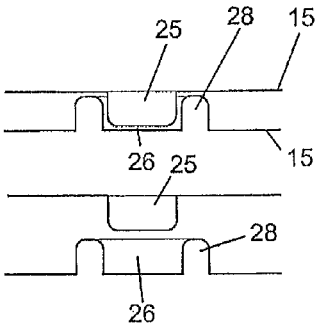
FIG. 14 shows a schematic representation of another lock connection according to an embodiment of the presently disclosed invention, consisting of a snap-in button that can lock in a corresponding locking socket.

FIG. 14 shows schematically the formation of another locking device as compared to the snap-in buttons (20, 21) and the coordinated locking edges (22, 23). Here, it is shown that one or more snap-in buttons 25 are provided as a projection on the bottom wall 15, which can lock with coordinated locking sockets 26 on the other bottom wall, each locking socket 26 being formed by side walls 28.

LEGEND FOR THE FIGURES

1 packing box
2 packing box
3 side wall
4 side wall
5 side wall
6 side wall
7 end wall/end face
8 end wall/end face
9 closure lid
10 closure lid
11 guide shoulder
12 cross wall
13 joint
14 connection cam
15 bottom wall

17 film hinge
18 arrow direction
19 arrow direction
20 snap-in button
21 snap-in button
22 locking edge
23 locking edge
24 pivot axis
25 snap-in buttons
26 locking socket
27 interruption
28 side wall

We claim:

1. A system of boxes wherein each of said boxes defines a bottom wall and at least one side wall that is connected to said bottom wall, said system comprising:

at least two boxes that are arranged adjacent to each other and oriented such that at least one side wall of each of said boxes opposes the side wall of at least another of said boxes;

at least two closure lids, said closure lids corresponding respectively to each of said at least two boxes, each of said closure lids cooperating with said respective box to selectively cover an opening defined, at least in part, by said at least one side wall of said respective box;

at least one film hinge having a first part that is connected to the side wall of one of said boxes, said film hinge also having a second part that is connected to the side wall of a second box that is adjacent to said one box such that said one box is pivotal about said film hinge with respect to said second box, said film hinge defining an interruption region therein such that said film hinge is not continuous along said side wall of said one box and also is not continuous along said side wall of said second box; and at least one connection cam having first and second parts that are connected together, said connection cam being located in said interruption region of said film hinge and spanning said film hinge to rigidly connect said first part of said connection cam to the side wall of said one box that is connected to the first part of said film hinge, said film hinge also spanning said film hinge to rigidly connect the second part of said connection cam to the side wall of said second box that is connected to the second art of said film hinge the first part of said connection cam being breakable from the second part of said connection cam in response to the pivotal movement of said one box with respect to said second box about said film hinge.

2. The system of boxes of claim 1 wherein said one box is pivotal about said film hinge with respect to said second box to move the bottom of said one box toward the bottom of said second box to stack said one box against said second box, said system further comprising at least one locking member connected respectively to each of the bottom of said one box and the bottom of said second box, said locking member that is connected to the bottom of said one box being engagable with the locking member that is connected to the bottom of said second box to detachably lock said one box with said second box.

3. The system of boxes of claim 1 wherein the side wall and the bottom wall of said one box are connected along a first linear junction and wherein the side wall and the bottom wall of said second box are connected along a second linear junction, said first part of said film hinge being connected to the side wall of said one box at a location on said side wall that is substantially opposite from the first linear junction, said second part of said film hinge being connected to the side wall of said second box at a location on said side wall that is substantially opposite from the second linear junction such that said film hinge pivots about an axis that is parallel to the first linear junction and also parallel to the second linear junction.

4. The system of boxes of claim 3 wherein the first part of said connection cam is rigidly connected to the side wall of said one box at a location on said side wall that is substantially opposite from the first linear junction, and wherein the second part of said connection cam is rigidly connected to the side wall of said second box at a location on said sidewall that also is substantially opposite from the second linear junction.

5. The system of boxes of claim 1 wherein at least one of said closure lids cooperates with said respective box by sliding engagement with said respective box.

6. The system of boxes of claim 2 wherein said at least one locking member is selected from the group comprising snap-in buttons and locking sockets.

7. The system of boxes of claim 1, said film hinge being separable between said first part and said second part to separate said one box from said second box.

8. The system of boxes of claim 1 wherein said at least two boxes comprises three or more boxes.

9. A system of boxes wherein each of said boxes defines a bottom wall, side walls that are located at oppositely disposed edges of said bottom wall, and end walls that are located at oppositely disposed edges of said bottom wall and between said side walls, said system comprising:

at least two boxes that are arranged adjacent to each other and oriented such that at least one end wall of one of said boxes opposes an end wall of a second of said boxes;

at least two closure lids, said closure lids corresponding respectively to each of said at least two boxes, each of said closure lids cooperating with said respective box to selectively cover an opening defined by said side walls and said end walls of said respective box;

at least one film hinge, having a first part that is pivotally connected to a second part, the first part of each film hinge being connected to an end wall of said one box and the second part of each film hinge being connected to the end wall of said second box that opposes the end wall of said one box such that said one box is pivotal about said film hinge with respect to said second box, said film hinge defining an interruption region therein such that the first part of said film hinge is not continuous along the end wall of said one box and such that the second part of said film hinge is not continuous along the end wall of said second box; and at least one connection cam having first and second parts that are connected together said connection cam being located in the interruption region of said film hinge and spanning said film hinge to rigidly connect the first part of said connection cam to the end wall of said one box and to rigidly connect the second part of said connection cam to the end wall of said second box, the first part of said connection cam being connected to the end wall of said one box that is connected to the first part of said film hinge, the second part of said connection cam being connected to the end wall of said second box that is connected to the second part of the same film hinge as said one box, the first part of said connection cam being breakable from the second part of said connection cam in response to the pivotal movement of said one box with respect to said second box about said film hinge.

10. A system of boxes wherein each of said boxes defines a bottom wall and at least one side wall that is connected to said bottom wall, said system comprising:

at least two boxes that are arranged adjacent to each other and oriented such that at least one side wall of each of said boxes opposes the side wall of at least another of said boxes;

at least two closure lids, said closure lids corresponding respectively to each of said at least two boxes, each of said closure lids cooperating with said respective box to selectively cover an opening defined at least in part by said at least one side wall of said respective box;

at least one film hinge, each film hinge having a first part connected to the side wall of one of said boxes and also having a second part connected to the side wall of another of said boxes that is adjacent to said one box such that said one box is pivotal about said film hinge with respect to said another box to move the bottom of said one box toward the bottom of said another box to stack said one box against said another box, said system further comprising at least one locking member connected respectively to the bottom of said one box and to the bottom of said another box, said locking member that is connected to the bottom of said one box being engagable with the locking member that is connected to the bottom of said another box to detachably lock said one box with said another box; and at least one connection cam, each connection cam being respectively connected to the side wall of said one box that is connected to the first part of said film hinge and also being connected to the side wall of said another box that is adjacent to said one box and that is connected to the second part of the same film hinge as said one box, each connection cam corresponding respectively to one film hinge and spanning said film hinge to rigidly connect to said one box and to said another box, said connection cam being breakable in response to the pivotal movement of said one box with respect to said another box about said film hinge.

11. The system of boxes of claim 10 wherein said at least one locking member is selected from the group comprising snap-in buttons and locking sockets.

12. The system of boxes of claim 10, said film hinge being separable between said first part and said second part to separate said one box from said second box.

13. The system of boxes of claim 10 wherein said at least two boxes comprises three or more boxes.

14. A system of boxes wherein each of said boxes defines a bottom wall and at least one side wall that is connected to said bottom wall, said system comprising:

at least two boxes that are arranged adjacent to each other and oriented such that at least one side wall of one box opposes the side wall of at least another of said boxes, the side wall and the bottom wall of said one box being connected along a first linear junction and the side wall and the bottom wall of said another box being connected along a second linear junction;

at least two closure lids, said closure lids corresponding respectively to each of said at least two boxes, each of said closure lids cooperating with a respective box to selectively cover an opening at least partly defined by said at least one side wall of said respective box; and at least one film hinge having a first part that is connected to the side wall of one of said boxes at a location on said side wall that is substantially opposite from the first linear junction, said film hinge also having a second part that is connected to the side wall of a second box at a location on said side wall that is substantially opposite from the second linear junction, said one box being pivotal with respect to said second box about an axis that is parallel to the first linear junction and also parallel to the second linear junction to move the bottom of said one box toward the bottom of said another box to stack said one box against said another box, said system further comprising at least one locking member connected respectively to the bottom of said one box and to the bottom of said another box, said locking member that is connected to the bottom of said one box being engagable with the locking member that is connected to the bottom of said another box to detachably lock said one box with said another box.

15. The system of boxes of claim 14 further comprising at least one connection cam, each connection cam being rigidly connected to the side wall of said one box that is connected to a film hinge, said connection cam being connected at a location on said side wall that is substantially opposite from the first linear junction, and said connection cam also being rigidly connected to the side wall of said second box that is adjacent to said one box and that is connected to the same film hinge as said one box, said connection cam being connected at a location on said side wall that also is substantially opposite from the second linear junction, each of said connection cams corresponding respectively to one film hinge and spanning said film hinge and rigidly connecting the connection cam to said one box and to said second box, said connection cam being breakable in response to the pivotal movement of said one box with respect to said another box about said film hinge.

16. The system of boxes of claim 14 wherein at least one of said closure lids cooperates with said respective box by sliding engagement with said respective box.

* * * * *